US006089212A

United States Patent [19]

Piock et al.

[11] Patent Number: 6,089,212

[45] Date of Patent: Jul. 18, 2000

[54] INTERNAL COMBUSTION ENGINE

[75] Inventors: Walter Piock; Martin Wirth, both of Hitzendorf; Alexander Fürschuss; Paul Kapus, both of Graz, all of Austria

[73] Assignee: AVL List GmbH, Graz, Austria

[21] Appl. No.: 09/010,850

[22] Filed: Jan. 22, 1998

[30] Foreign Application Priority Data

Jan. 23, 1997 [AT] Austria ..... GM39/97

[51] Int. Cl.[7] ..... F02B 47/08

[52] U.S. Cl. ..... 123/568.7; 123/568.2

[58] Field of Search ..... 60/278; 123/568.17, 123/568.18, 568.2

[56] References Cited

U.S. PATENT DOCUMENTS

| | | | |
|---|---|---|---|
| 4,175,522 | 11/1979 | Kawamura et al. | 123/568.17 |
| 4,192,265 | 3/1980 | Amano et al. | 123/568.17 |
| 4,261,316 | 4/1981 | Motosugi et al. | 123/568.18 |
| 4,693,226 | 9/1987 | Choma | 123/568.17 |
| 5,427,080 | 6/1995 | Maeda et al. | 123/568.2 |
| 5,490,488 | 2/1996 | Aversa et al. | 123/568.17 |

FOREIGN PATENT DOCUMENTS

| | | |
|---|---|---|
| 0558072 | 9/1993 | European Pat. Off. . |
| 0594462 | 4/1994 | European Pat. Off. . |
| 3011580 | 10/1981 | Germany . |

*Primary Examiner*—Thomas E. Denion
*Attorney, Agent, or Firm*—Watson Cole Grindle Watson, PLLC

[57] ABSTRACT

An internal combustion engine with a device for controlled recirculation of exhaust gas into intake ducts via an exhaust gas recirculation line connected to the engine's exhaust system. Rapid response behaviour is achieved by providing an exhaust gas recirculation port in each intake duct in the immediate vicinity of the cylinders, which port communicates with a distributing device supplied via an exhaust gas recirculation line, and by providing the distributing device with an adjusting element which is configured to jointly control the flow cross-sections of the exhaust gas recirculation ports.

15 Claims, 4 Drawing Sheets

INTERNAL COMBUSTION ENGINE

BACKGROUND OF THE INVENTION

The present invention relates to an internal combustion engine with a device for controlled recirculation of exhaust gas into intake ducts via an exhaust gas recirculation line connected to the engine's exhaust system.

DESCRIPTION OF THE PRIOR ART

Exhaust gas, recirculation is a known process which is employed to improve emission behaviour and reduce fuel consumption in internal combustion engines. Such processes are employed both with spark ignition engines and diesel engines. By lowering temperatures in the combustion chamber it is possible to reduce NOx emissions, above all. Besides, a reduction in fuel consumption may be achieved in the throttled spark ignition engine as a consequence of the additional throttling effect due to exhaust gas recirculation.

In conventional exhaust gas recirculation systems the exhaust gas is diverted from the exhaust system and induced into a manifold in the intake system. Between the openings on the exhaust side and intake side an adjusting element is provided which controls the amount of exhaust gas recirculated. Since such systems necessitate a comparatively large distance between the site where the exhaust gas is introduced into the intake system and the combustion chamber, the dynamic performance to be achieved is comparatively poor. This is due to the fact that any change in the position of the adjusting element will modify the volume of recirculated exhaust gas only with a delay of several engine cycles. This will have negative effects on the driveability of the vehicle in which the internal combustion engine is mounted, and on the emission behaviour.

In EP 0 594 462 A1 an exhaust gas recirculation system is disclosed which is configured for internal combustion engines with at least two intake valves. The exhaust gas is introduced only into one of the intake ports. Introduction takes place via a manifold which is positioned upstream, relatively far away from the corresponding intake valve. With the use of throttle valves the amount of intake air admitted into each of the respective intake valves may be varied. In this manner the volume of recirculated exhaust gas may be adjusted and stratification of the exhaust gas may be achieved in the combustion chamber. Due to the relatively large distances and volumes required with this configuration, the same disadvantages are encountered as described above.

EP 0 558 072 A discloses a spark ignition engine with direct fuel injection, which exhibits an unusual arrangement of intake passages going through the cylinder head. This special arrangement will permit very short lines for exhaust gas recirculation, leading from the exhaust passage of each cylinder to the intake passage of the same cylinder. By means of a common control valve the volumes of recirculated exhaust gas of the individual cylinders are jointly controlled. Since with this kind of arrangement the exhaust gases are directly recirculated to the intake port as soon as they have left the cylinder, considerable heat problems will arise, which will be accompanied by the formation of deposits and carbon build-up in the exhaust gas recirculation ducts and undesired heat accumulation in the cylinder head. With this type of configuration the cylinder head itself is most complex and difficult to produce. The main drawback of this solution is the occurrence of strong fluctuations in the amount of recirculated exhaust gas on account of the gas dynamic conditions prevailing in certain operational states.

SUMMARY OF THE INVENTION

It is the object of the present invention to propose a device which is free of the above disadvantages and will offer a simple system of exhaust gas recirculation exhibiting rapid response behaviour and precise control of the amount of exhaust gas recirculated.

According to the invention this object is achieved by providing an exhaust gas recirculation port in each intake duct in the immediate vicinity of the cylinders, which port communicates with a distributing device supplied via an exhaust gas recirculation line, and by providing the distributing device with an adjusting element which is configured to jointly control the flow cross-sections of the exhaust gas recirculation ports.

It is an essential feature of the present invention that dead volumes in the intake systems are largely avoided, first of all by collecting the exhaust gases from a group of cylinders and delivering them to a distributing device via an exhaust gas recirculation line. The distributing device is provided with an adjusting element jointly controlling the amount of exhaust gas to be recirculated to the individual cylinders. The present invention will help avoid the disadvantages referred to above while offering simplicity of design.

In a preferred embodiment of the invention the distributing device is configured as a pipe running substantially parallel to the longitudinal axis of the engine. In the distributing device configured as a pipe a slide valve moving in longitudinal direction may be provided for the controlled opening of ports which are connected to the exhaust gas recirculation lines. It would also be possible to use a rotary valve for the controlled opening of ports which are connected to the exhaust gas recirculation lines.

In order to permit a precisely defined recirculation of small volumes of exhaust gas the adjusting element may be provided with an auxiliary bore which defines a predetermined small opening cross-section for exhaust gas recirculation. In this manner precise control of a small amount of exhaust gas will be possible in a mean position of the adjusting element, even in the presence of manufacturing tolerances or other inaccuracies.

It will prove of advantage to provide the adjusting element with two or more independent flow paths for individual cylinders or groups of cylinders. In this way any mutual influences between individual cylinders may be minimised. In the instance of a four-cylinder in-line engine, each pair of cylinders with an ignition angle of 360° will be supplied jointly, as there will be little mutual influence. In the instance of the usual firing order 1-3-4-2, cylinders 1,4 and cylinders 2,3, respectively, will be supplied jointly.

In a preferred embodiment an additional exhaust gas recirculation valve may be provided upstream of the adjusting element. This will permit most precise control of the volume of exhaust gas to be recirculated.

DESCRIPTION OF THE DRAWINGS

Following is a more detailed description of embodiments of the invention as illustrated by the accompanying drawings, in which.

DETAILED DESCRIPTION OF THE PREFERRED EMBODIMENTS

Figure 1:
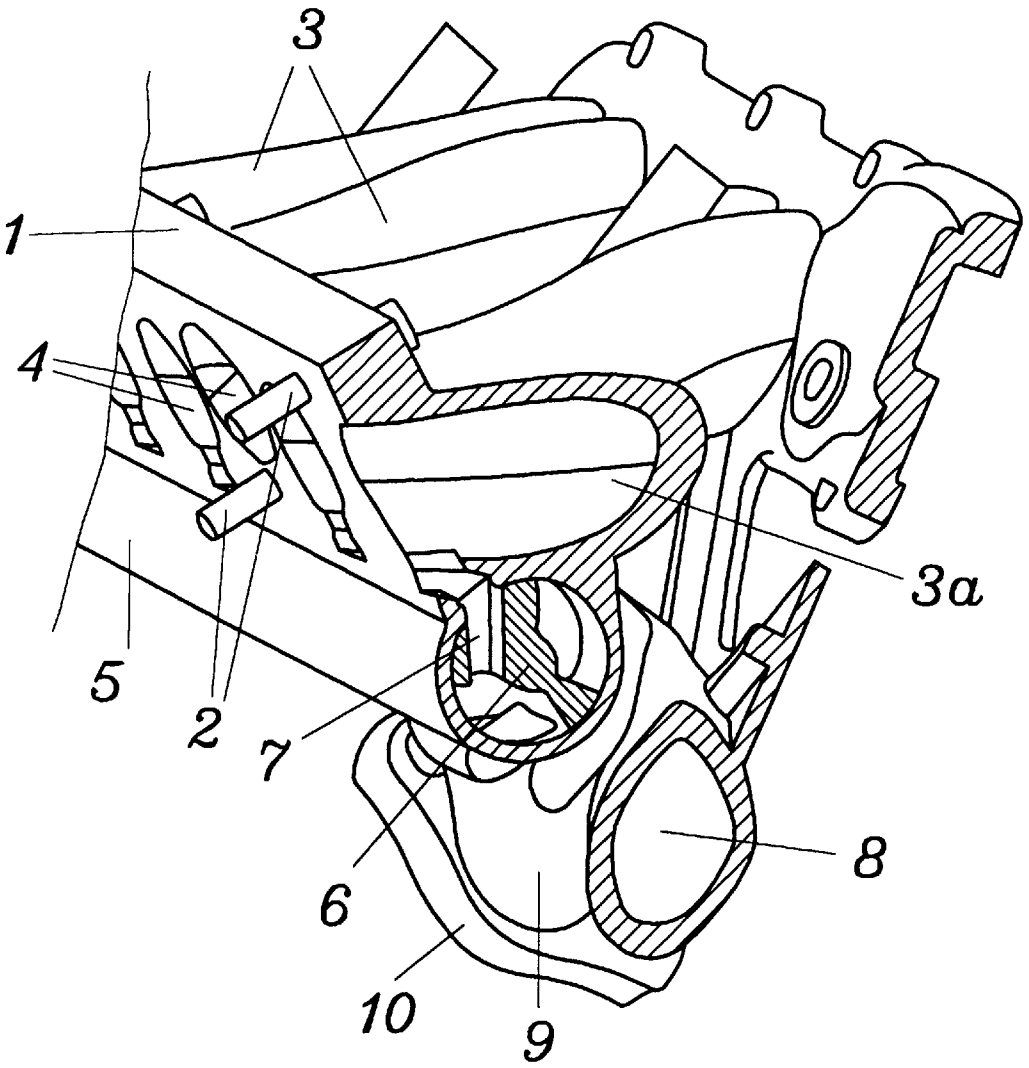
FIG. 1 is a partially cut, axonometric representation of the exhaust gas recirculation system of an internal combustion engine in accordance with the invention.
Figure 6:
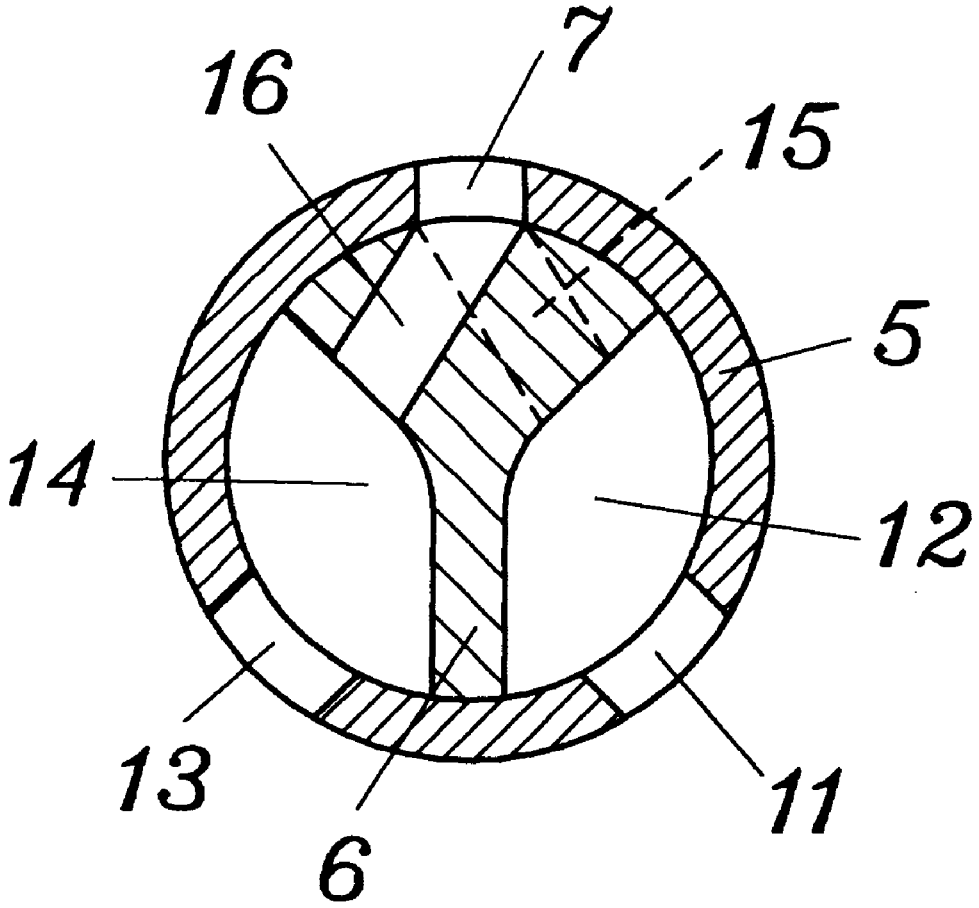
FIG. 6 is a section through a distributing device of yet another variant of the invention.

FIG. 1 represents an intake manifold of an internal combustion engine in accordance with the invention. The flange 1 is designed to be fastened to the cylinder head of the engine not further shown in FIG. 1 by means of bolts 2. Intake pipes 3 open into ports 4 inducing the intake air. 3*a* refers to a partially cut intake duct. Parallel to the flange 1 and in one piece therewith, a pipe 5 is provided, which serves as distributing device. An adjusting element 6 configured as a rotary valve is positioned inside this pipe 5. The adjusting element 6 controls the opening of an exhaust gas recirculation port 7 in order to adjust the amount of exhaust gas recirculated. Via an opening 8 exhaust gas is delivered from an exhaust gas recirculation line not shown in FIG. 1 to a collecting pipe 9. Another exhaust gas recirculation line from another cylinder group may be attached to flange 10. FIG. 6 gives a view of the distributing device in greater detail. The exhaust gases from a first exhaust gas recirculation line are induced via a first opening 11 in the distributing device 5 into a first distributor space 12, which is formed between the adjusting element 6 and the pipe 5. The exhaust gases supplied from a second exhaust gas recirculation line are induced via an opening 13 into a space 14 which is also defined by the adjusting element 6 and the pipe 5. In a four-cylinder engine, for example, the exhaust gas from cylinders 1 and 4 may be delivered into channel 12 via opening 11, whereas the exhaust gas from cylinders 2 and 3 is delivered into channel 14 via opening 13. A first group of openings 15 communicates with the first channel 12, whereas a second group of openings 16 communicates with the second channel 14. In the position shown in FIG. 6 the exhaust gas recirculation ports 7 leading into the intake passage are fully opened.

Figure 2:
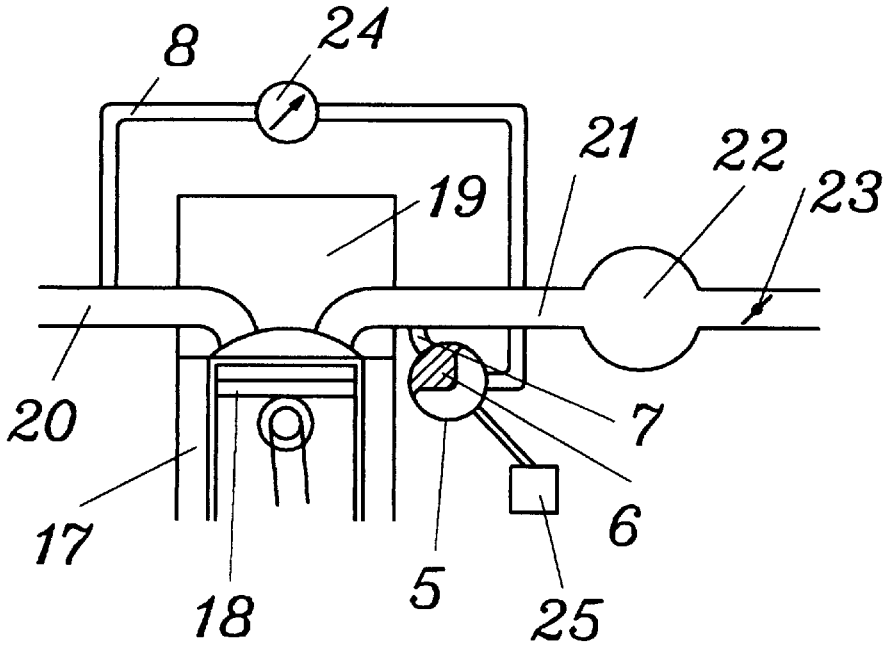
FIG. 2 is a schematical representation of a variant of the exhaust gas recirculation system of the invention.

FIG. 2 is a schematical view of the cylinder block 17 of an internal combustion engine with a movable piston 18. Exhaust ducts 20 depart from the cylinder head 19. Intake ducts 21 are connected on their upstream side to a collector 22, before which a throttle valve 23 is positioned. An exhaust gas recirculation line 8 is provided with an exhaust gas recirculation valve 24 and leads to a distributing device 5 in which a rotary valve 6 is placed as an adjusting element. By means of the rotary valve 6 the opening of the exhaust gas recirculation port 7 is controlled. As is shown schematically, the distrubuting device 5 also communicates with a crankcase vent or tank vent 25.

Figure 3:
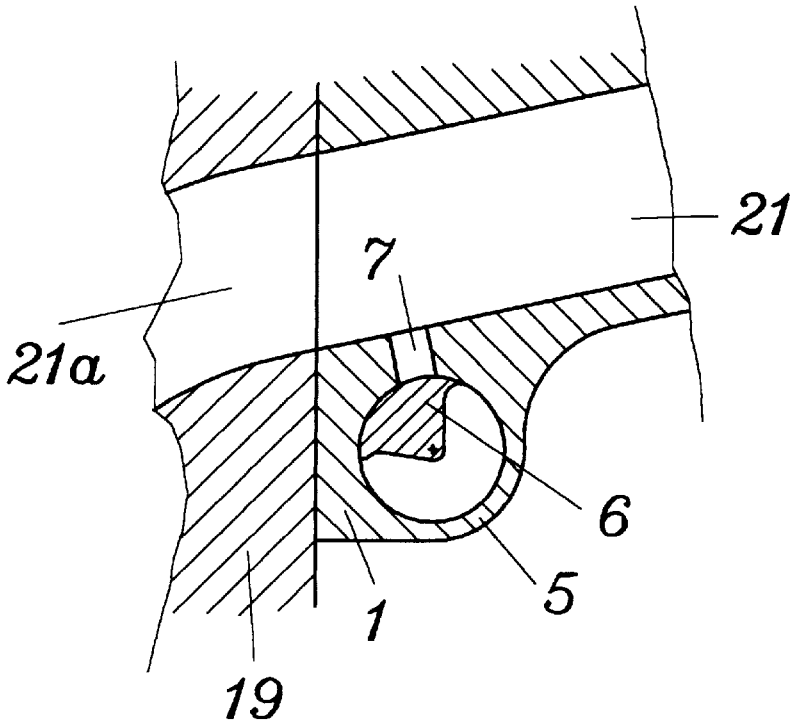
FIG. 3 shows a detail from FIG. 2.

FIG. 3 gives a detailed view of the distributing device 5. In the cylinder head 19 is located the intake duct 21*a*. The distributing device 5 is made in one piece with the flange 1 of the intake manifold. In the position shown in FIG. 3 the adjusting element 6 closes the intake port 7.

Figure 4:
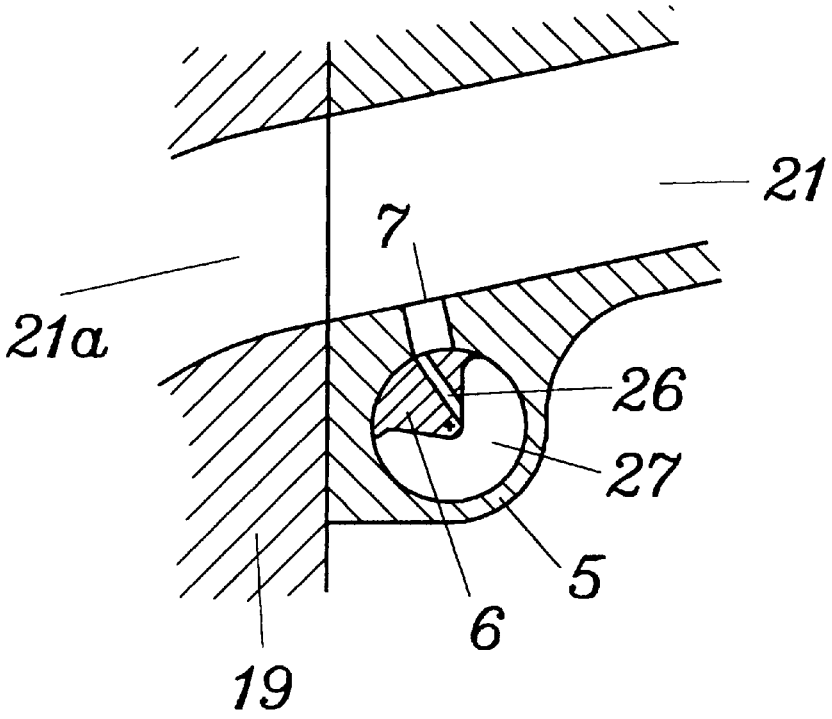
FIGS. 4 and 5 show further variants of the invention, their representation corresponding to that in FIG. 3.

The variant in FIG. 4 differs from that of FIG. 3 in that an auxiliary bore 26 is provided in the adjusting element 6. In the position of the adjusting element 6 shown in FIG. 4 the channel 27 of the distributing device 5 communicates with the recirculation port 7 via the auxiliary bore 26. In this variant it will be possible to open a small, well-defined cross-section for exhaust gas recirculation without having to accurately define the position of the adjusting element 6.

Figure 5:
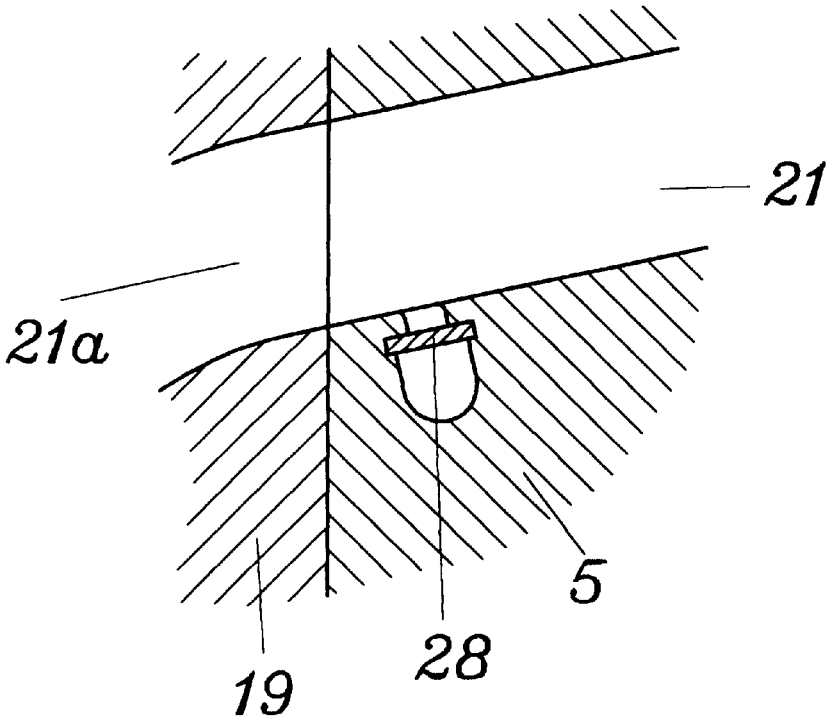

FIG. 5 shows a variant of the invention in which a flat slide valve 28 is used to adjust the opening cross-section for exhaust gas recirculation.

The present invention will enable large volumes of exhaust gas of greater than 25% to be recirculated, and will considerably improve the dynamic performance of the engine as well as vehicle driveability. The configuration proposed by the invention is simple and easy to implement.

What is claimed is:

1. An internal combustion engine comprising a plurality of cylinders;

a plurality of intake ducts respectively connected to said cylinders for delivering air thereto, said intake ducts having recirculation ports for exhaust gas;

an exhaust system connected to said cylinder for removing exhaust gas from said cylinders; and an exhaust gas recirculation system connected between said exhaust system and said recirculation ports, said exhaust gas recirculation system including a distributing device containing an adjusting element which controls flow cross-sections of said recirculation ports, said adjusting element including a bore which defines a predetermined small opening cross-section for exhaust gas recirculation.

2. An internal combustion engine as claimed in claim 1, wherein said distributing device comprises a pipe that extends substantially parallel to a longitudinal axis of the engine.

3. An internal combustion engine as claimed in claim 2, wherein said adjusting element comprises a slide valve which is movable in a longitudinal direction thereof and is used for controlled opening of the recirculation ports.

4. An internal combustion engine as claimed in claim 2, wherein said adjusting element comprises a rotary valve for controlled opening of the recirculation ports.

5. An internal combustion engine as claimed in claim 1, including one of a crankcase vent and a tank vent connected to the distributing device.

6. An internal combustion engine comprising a plurality of cylinders;

a plurality of intake ducts respectively connected to said cylinders for delivering air thereto, said intake ducts having recirculation ports for exhaust gas;

an exhaust system connected to said cylinder for removing exhaust gas from said cylinders; and an exhaust gas recirculation system connected between said exhaust system and said recirculation ports, said exhaust gas recirculation system including a distributing device containing an adjusting element which controls flow cross-sections of said recirculation ports, said adjusting element defining at least two separate flow channels for individual cylinders or groups of cylinders.

7. An internal combustion engine as claimed in claim 6, wherein said distributing device comprises a pipe that extends substantially parallel to a longitudinal axis of the engine.

8. An internal combustion engine as claimed in claim 6, wherein said adjusting element comprises a slide valve which is movable in a longitudinal direction and is used for controlled opening of the recirculation ports.

9. An internal combustion engine as claimed in claim 6, wherein said adjusting element comprises a rotary valve for controlled opening of the recirculation ports.

10. An internal combustion engine as claimed in claim 6, including one of a crankcase vent and a tank vent connected to the distributing device.

11. An internal combustion engine comprising a plurality of cylinders;

a plurality of intake ducts respectively connected to said cylinders for delivering air thereto, said intake ducts having recirculation ports for exhaust gas;

an exhaust system connected to said cylinder for removing exhaust gas from said cylinders; and an exhaust gas recirculation system connected between said exhaust system and said recirculation ports, said exhaust gas recirculation system including a distributing device containing an adjusting element which controls flow cross-sections of said recirculation ports, and a recirculation valve upstream of said adjusting element.

12. An internal combustion engine as claimed in claim 11, wherein said distributing device comprises a pipe that extends substantially parallel to a longitudinal axis of the engine.

13. An internal combustion engine as claimed in claim 11, wherein said adjusting element comprises a slide valve which is movable in a longitudinal direction and is used for controlled opening of the recirculation ports.

14. An internal combustion engine as claimed in claim 11, wherein said adjusting element comprises a rotary valve for controlled opening of the recirculation ports.

15. An internal combustion engine as claimed in claim 11, including one of a crankcase vent and a tank vent connected to the distributing device.

* * * * *